US007854265B2

(12) United States Patent
Zimmermann

(10) Patent No.: US 7,854,265 B2
(45) Date of Patent: Dec. 21, 2010

(54) PIPE GRIPPING ASSEMBLY WITH POWER SCREW ACTUATOR AND METHOD OF GRIPPING PIPE ON A RIG

(75) Inventor: Kris D. Zimmermann, Calgary (CA)

(73) Assignee: Tesco Corporation, Houston, TX (US)

( * ) Notice: Subject to any disclaimer, the term of this patent is extended or adjusted under 35 U.S.C. 154(b) by 136 days.

(21) Appl. No.: 12/164,713

(22) Filed: Jun. 30, 2008

(65) Prior Publication Data

US 2009/0321086 A1 Dec. 31, 2009

(51) Int. Cl.
*E21B 19/18* (2006.01)

(52) U.S. Cl. ..... 166/379; 166/77.51

(58) Field of Classification Search ..... 166/77.51, 166/90.1, 78.1, 379, 380
See application file for complete search history.

(56) References Cited

U.S. PATENT DOCUMENTS

| | | | | |
|---|---|---|---|---|
| 4,593,773 | A | 6/1986 | Skeie | |
| 5,433,279 | A | 7/1995 | Tessari et al. | |
| 6,527,047 | B1 | 3/2003 | Pietras | |
| 6,622,796 | B1 | 9/2003 | Pietras | |
| 6,705,405 | B1 | 3/2004 | Pietras | |
| 6,742,584 | B1 | 6/2004 | Appleton | |
| 7,004,259 | B2 | 2/2006 | Pietras | |
| 7,140,443 | B2 | 11/2006 | Beierbach et al. | |
| 7,140,445 | B2 | 11/2006 | Shahin et al. | |
| 7,213,656 | B2 | 5/2007 | Pietras | |
| 2003/0173073 | A1 * | 9/2003 | Snider et al. | 166/78.1 |
| 2009/0145594 | A1 | 6/2009 | Slack | |

* cited by examiner

*Primary Examiner*—Shane Bomar
*Assistant Examiner*—Catherine Loikith
(74) *Attorney, Agent, or Firm*—Bracewell & Giuliani LLP

(57) ABSTRACT

A pipe gripping assembly having a quill, an actuator and a drive assembly mounts to a top drive of a drilling rig. The quill is connected to a mandrel in the drive assembly. The drive assembly has a tapered mandrel and a set of slips that move along the taper into and out of engagement with the pipe. The actuator is connected to both the quill and a portion of the drive assembly. The actuator includes a motor and at least two sleeves that are threaded together. One sleeve has a spline on its outside diameter that mates to the motor and a gear. Power applied to the motor causes the actuator to move slips in the drive assembly into an engagement position that grips the pipe for lifting and rotating the pipe.

22 Claims, 6 Drawing Sheets

PIPE GRIPPING ASSEMBLY WITH POWER SCREW ACTUATOR AND METHOD OF GRIPPING PIPE ON A RIG

FIELD OF THE INVENTION

This invention relates in general to mechanically actuated pipe grippers used to handle pipe during oil and gas well drilling and pipe running operations.

BACKGROUND OF THE INVENTION

During oil and gas well drilling operations, strings of pipe are used to both drill the well and line the drilled hole with conduit. The pipe is made up of discrete sections of pipe, each approximately 40 ft in length or in stands of approximately 90 feet in length. These sections of pipe are made up to one another at the rig via locking and sealing connections, typically threads, and then lowered into the well. In many cases, it is necessary to turn the connected sections of pipe while lowering them into the well, either to support a drilling activity or to help keep the pipe from becoming stuck in the well.

In recent years, the rigs used to drill wells and install pipe have been modified to automate much of these activities that previously involved men working on the rig floors exposed to potentially dangerous conditions. Many modern rigs now have automated spiders at the rig floor to support the sections of pipe already installed in the well; top drives with pipe handling tools for gripping sections of pipe, lifting them and turning them; and other ancillary equipment to assist in the handling and manipulation of the pipe during drilling and running operations.

Pipe handling tools mounted to the top drive typically used a quill connected by threads to the top drive through which both lifting forces and torsional forces could be selectively applied to pipe. Surrounding the quill typically was a set of slips that could be moved along a tapered surface into an engaging connection with the pipe. The tapered surface could either be an internally tapered surface or an externally tapered surface, depending on whether internal gripping or external gripping is desired. An actuator is required to move the slips between the engaging connection with the pipe and a disengaged position. Typically, the actuator is made up of a number of pneumatic or hydraulic cylinders that are mounted around the quill and connected to the slips to effect movement of the slips from a released position to an engaged position with the pipe. Alternatively, a pneumatic or hydraulic mono-cylinder could be mounted around the quill using multiple sleeves and connected to the slips to effect movement of the slips.

SUMMARY

The actuator of this invention has a quill having upper and lower ends and a passage therethrough. Surrounding the quill is an inner tubular member mounted in a fixed axial relation to the quill and including an external thread on its outside surface. Mounted to the inner tubular member is a motor with a shaft and gear. The gear interconnects to a spline on an outer tubular member that has an internal thread on its inner surface. The internal thread of the outer tubular member interconnects with the external thread of the inner tubular member. When power is applied to the motor to turn the shaft and gear, the gear acts against the spline and turns the outer tubular member with respect to the inner tubular member. This rotation along the thread between the inner and outer tubular members forces the outer tubular member to move axially in relation to the inner tubular member. The outer tubular member is connected to a drive assembly, comprising a mandrel with a tapered surface and slips mounted around the tapered surface. The mandrel is connected to the lower end of the quill typically via pipe threads. Axial movement of the outer tubular member with respect to the quill causes slips to move along the tapered surface of the mandrel from an engaging connection with the pipe to a disengaged position. The slips could also be mounted inside an external mandrel with inwardly facing tapered surface to allow the slips to grip the pipe externally.

In a preferred embodiment, bearings are used to isolate the inner and outer tubular members from the quill when it is rotated in operation. One or more bearings are positioned between the inner tubular member and the quill. And, one or more bearings are also positioned between the outer tubular member and the components connecting it to the slips. An anti-rotation element between the upper tubular member and the top drive keeps the tubular members from rotating with the quill during operations.

In an alternative embodiment, the motor could be mounted to the outer tubular member and the gear connected to a spline on the outside surface of the inner tubular member. In this configuration, when power is applied to the motor, the gear acts against the spline and turns the inner tubular member with respect to the outer tubular member. In this way, rotation along the thread between the inner and outer tubular members forces the outer tubular member to move axially in relation to the inner tubular member. The outer tubular member is connected to slips mounted around the tapered outer surface of the lower end of the quill. Axial movement of the outer tubular member with respect to the quill causes slips to move from an engaging connection with the pipe to a disengaged position. Bearings may be used to isolate rotation of the quill from the inner and outer tubular members. Bearings may also be used to isolate rotation of the slips from the outer tubular member. And, anti-rotation of the outer tubular member could be accomplished by interconnection to the top drive.

DETAILED DESCRIPTION OF THE INVENTION

Figure 3:
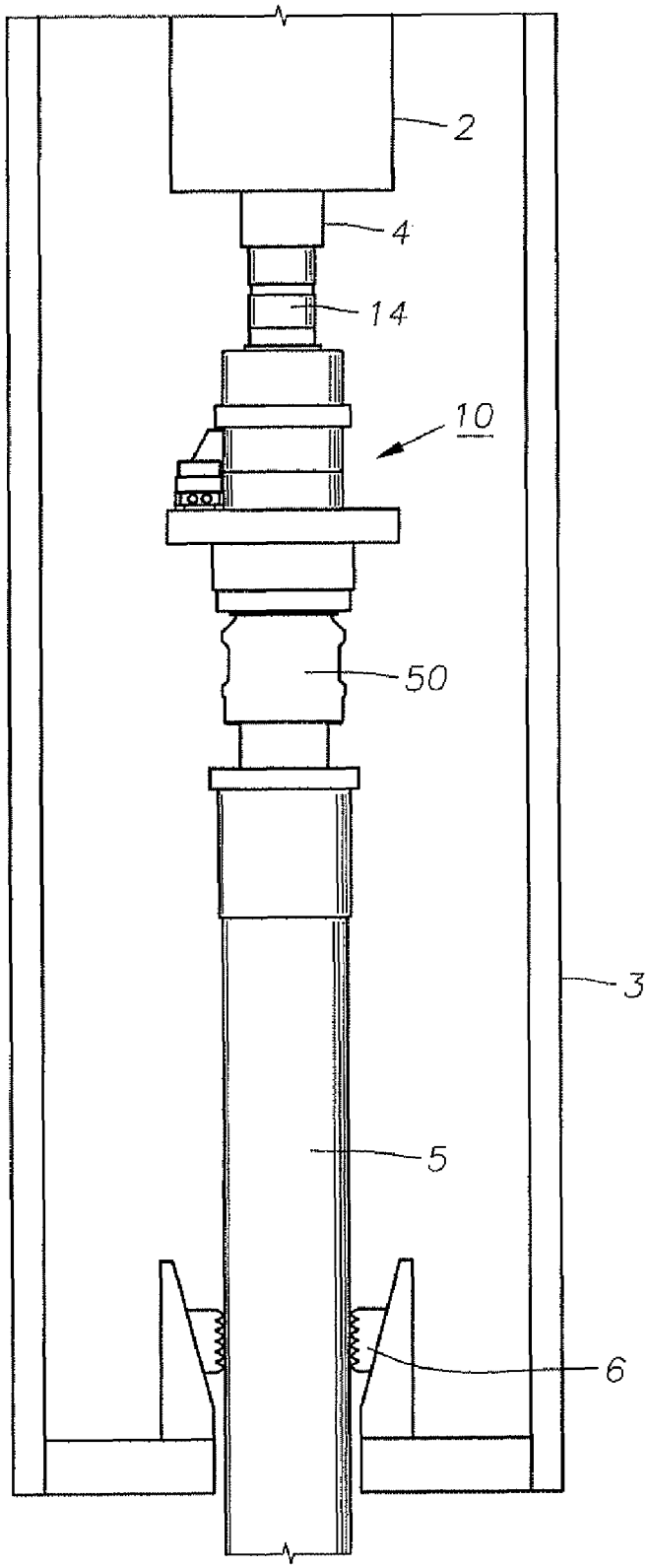
FIG. 3 is a schematic view of the internal pipe gripping assembly of FIGS. 1A and 1B shown mounted to a top drive of a drilling rig.

Referring to the schematic drawing of FIG. 3, a top drive 2 moves up and down a derrick 3 of a drill rig. Top drive 2 has a rotatably driven drive stem 4. When drilling, drive stem 4 may be connected to drill pipe (not shown) to lift and rotate the drill pipe. Alternately, it may be connected to a string of casing 5 for drilling with casing or running casing into a previously drilled borehole. A pipe gripping assembly 10 connects between top drive stem 4 and casing string 5. When pipe gripping assembly 10 is disconnected from casing string 5, a spider or power slips 6 at the rig floor suspends casing string 5.

Figure 1A:
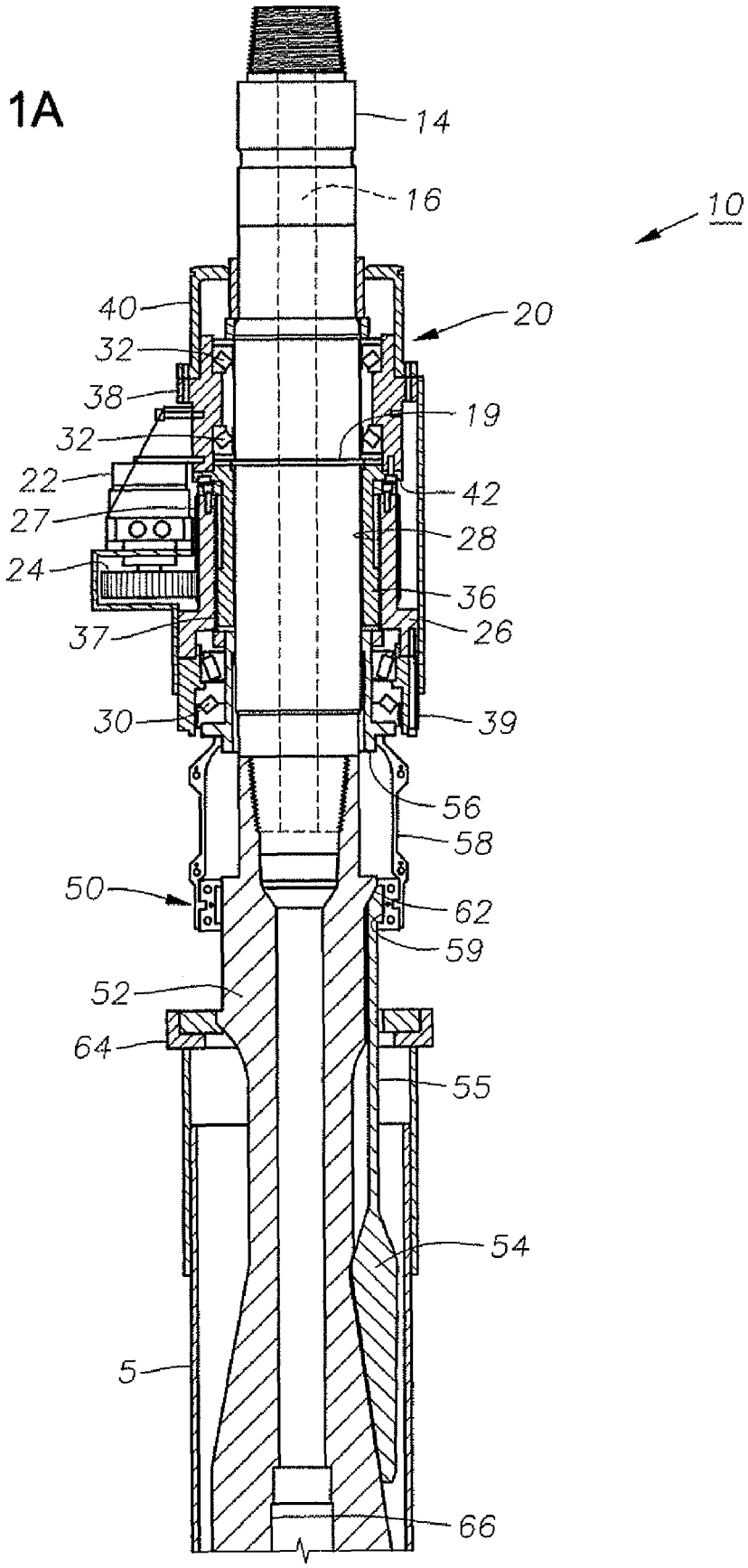
FIG. 1A is sectional view of an internal pipe gripping assembly with an actuator constructed in accordance with this invention and shown in a pipe disengaged position.

FIG. 1A shows a sectional view of one embodiment of a pipe gripping assembly 10 according to the present invention. The pipe gripping assembly 10 comprises a quill 14, an actuator 20, and a drive assembly 50. The quill 14 is a heavy wall tubular member with a pipe thread on at least one end and a flow bore 16 through its center. The quill 14 is capable of being made up to top drive 2 (FIG. 3) on a drilling rig via the pipe thread to allow the pipe gripping assembly 10 to be manipulated by the top drive 2, including lifting and turning activities. The quill 14 has a shoulder 19 on its outside diameter to allow portions of the actuator 20 to be mounted in a fixed axial relation to the quill 14.

The actuator 20 is mounted in a surrounding relationship to the quill 14. An inner tubular member 36 is mounted in a fixed axial relation to the quill 14, but remains free to rotate with respect to the quill 14. The inner tubular member 36 has external threads 37 on a portion of its outside diameter. An outer tubular member 26 has internal threads 28 on a portion of its inside diameter and splines 27 on a portion of its outside diameter. The inner tubular member 36 and outer tubular member 26 are interconnected to each other via the respective threads 28, 37. The interconnecting threads 28, 37 can be of any known power thread type, including for example, an ACME thread, a stub-ACME thread or any other thread that is capable of transferring rotation between two bodies into axial translation between them (or vice-a-versa).

A motor 22 is mounted to an upper bearing sleeve 38, which is a portion of the inner tubular member 36. Upper bearing sleeve 38 has a cap 40 that extends in a sealing manner around quill 14. The motor 22 typically is a stepping motor that can be pneumatically, hydraulically or electrically driven. Quill 14 is rotatable relative to upper bearing sleeve 38 and motor 22. An anti-rotation member (not shown) extends from upper bearing sleeve 38 to the non-rotating portion of top drive 2 (FIG. 3) so as to prevent upper bearing sleeve 38, motor 22, inner tubular member 36 and outer tubular member 26 from rotation with quill 14. Power is supplied to motor 22 via a power line (not shown). The motor 22 has a gear 24 that mates to the splines 27 of the outer tubular member 26.

At an upper end of the actuator 20, the inner tubular member 36 is rigidly connected to upper bearing sleeve 38, which has internal profiles for mating to upper bearings 32 between the quill 14 and the upper bearing sleeve 38. At the lower end of actuator 20, the outer tubular member 26 is connected a lower bearing sleeve 39 that has internal profiles for mating to lower bearings 30 between the lower bearing sleeve 39 and an inner drive bearing sleeve 56. Inner drive bearing sleeve 56 is mounted to quill 14 for rotation therewith, such as by splines or keys. Bearings 30, 32 allow independent rotation of the quill 14 and actuator 20. Inner drive bearing sleeve 56 is axially movable relative to quill 14 along with outer tubular member 26. Stop shoulders 42 on outer tubular member 26 and inner tubular member 36 limit the downward movement of outer tubular member 26 relative to inner tubular member 36.

Drive assembly 50 is connected to both the quill 14 and the actuator 20. The drive assembly 50 includes a mandrel 52, a set of slips 54, a slip collar 59, a drive collar connector 58 and a stop ring 64. All of these components rotate in unison with quill 14. In the internally gripping configuration of FIGS. 1A and 1B, the mandrel 52 has an upper threaded end, a stop shoulder 62 and a lower tapered section with a bore from end to end. The mandrel 52 is connected to the quill 14 via pipe threads. A locking member (not shown) prevents inadvertent unscrewing of mandrel 52 from quill 14. Slips 54 mount to the mandrel 52 along the tapered section. The slips 54 include an elongated upper section 55 that provides a coupling feature for connection to the slip collar 59, which is split to allow it to be installed around the coupling feature. The slip collar 59 is connected to the drive collar connector 58, which is also split to allow a rib in the connector to fit in a slot in the slip collar 59. The drive collar connector 58 mates to the inner drive bearing sleeve 56 via a bolted or pinned arrangement. Stop ring 64 mounts to the mandrel 52 to prevent the mandrel and slips 54 from stabbing too far into the pipe. There are other ways to connect the slip collar 59 and drive collar connector 58 include bolting, threading or snap-ring arrangements, among others. Alternatively, the slip collar 59 and drive collar connector 58 could be made as one piece.

A spear head 65 (FIG. 4) threads and seals in a seal pocket 66 at the lower end of the bore in mandrel 52. Spear head 65 has seals 67 at its upper end that sealingly engage seal pocket 66. Spear head 65 has a bore 69 therethrough and a cup seal 71 for sealing to the inner diameter of casing 5 (FIG. 1A). A cup seat 73 supports cup seal 71 on the upper outside diameter of spear head 65.

Figure 5:
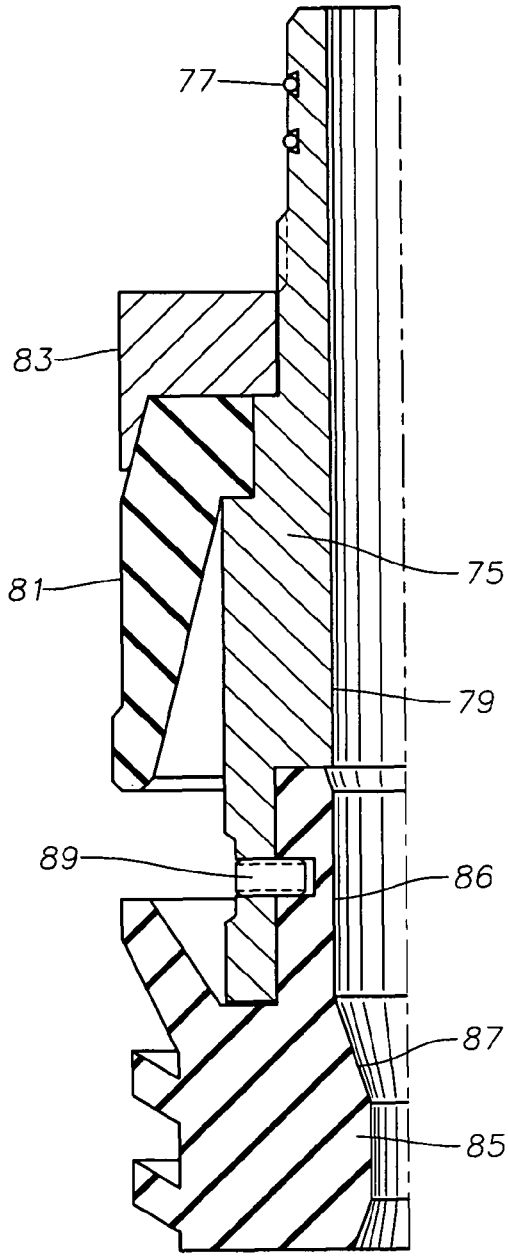
FIG. 5 is an enlarged sectional view of a spear head and plug launcher that attaches to the gripping assembly of FIG. 1A or 2A.

Referring to FIG. 5, for cementing operations, spear head 65 may be removed and replaced by a plug launcher 75. Plug launcher 75 has seals 77 on its upper under that sealingly engage seal pocket 66 (FIG. 1A). A bore 79 extends through plug launcher 75 for the passage of fluid. A cup seal 81 is mounted to the exterior of plug launcher 75 by a cup seat 83. Cup seal 81 sealingly engages the inner diameter of casing 5 (FIG. 1A). A plug 85 is releasably mounted to the lower end of plug launcher 75. Plug 85 sealingly engages the inner diameter of casing 5 and has a passage 86 extending through it that registers with and is the same diameter as bore 79. The lower portion of passage 86 is reduced in diameter, defining an upward facing seat 87. One or more shear screws 89 releasably retain plug 85 with plug launcher 75.

When plug 85 is to be dispensed, the operator drops a ball (not shown) into bore 79. The ball is larger in diameter than the lower portion of plug passage 86, causing the ball to land and seal against seat 87. Fluid is pumped down passage 79, and the pump pressure causes shear screw 89 to shear, releasing plug 85 to be pumped down casing 5 (FIG. 1A).

In operation, the pipe gripping assembly 10 is mounted to drive stem 4 of top drive 2 (FIG. 3) on a drilling rig via the pipe threads on the upper end of the quill 14. As mentioned above, in the installed position, the pipe gripping assembly 10 includes an anti-rotation bracket (not shown) that prevents rotation between the upper bearing sleeve 38 and the top drive 2. With the pipe gripping assembly 10 in the configuration shown in FIG. 1A, when the top drive 2 and pipe gripping assembly 10 are lowered onto a section of pipe such as casing 5, the mandrel 52 and slips 54 will pass into casing 5 until the stop ring 64 prevents farther passage into the casing. In this position, power is applied to the motor 22 to turn the gear 24. The gear 24 acts against the splines 27 and turns the outer tubular member 26 with respect to the inner tubular member 36, which is prevented from axial movement relative to quill 14. This relative rotation between the threads 28, 37 of the outer and inner tubular members 26, 36 forces the outer tubular member 26 to move axially in relation to the inner tubular member 36. Axial movement of the outer tubular member 26 imparts axial movement on the lower bearing sleeve 39. Lower bearing sleeve 39 in turn imparts axial movement, but not rotational movement, on the inner drive bearing sleeve 56 through bearings 30. Motor 22 thus causes outer tubular member 26 and lower bearing sleeve 39 to rotate while inner drive bearing sleeve 56 remain stationary relative to quill 14.

Figure 1B:
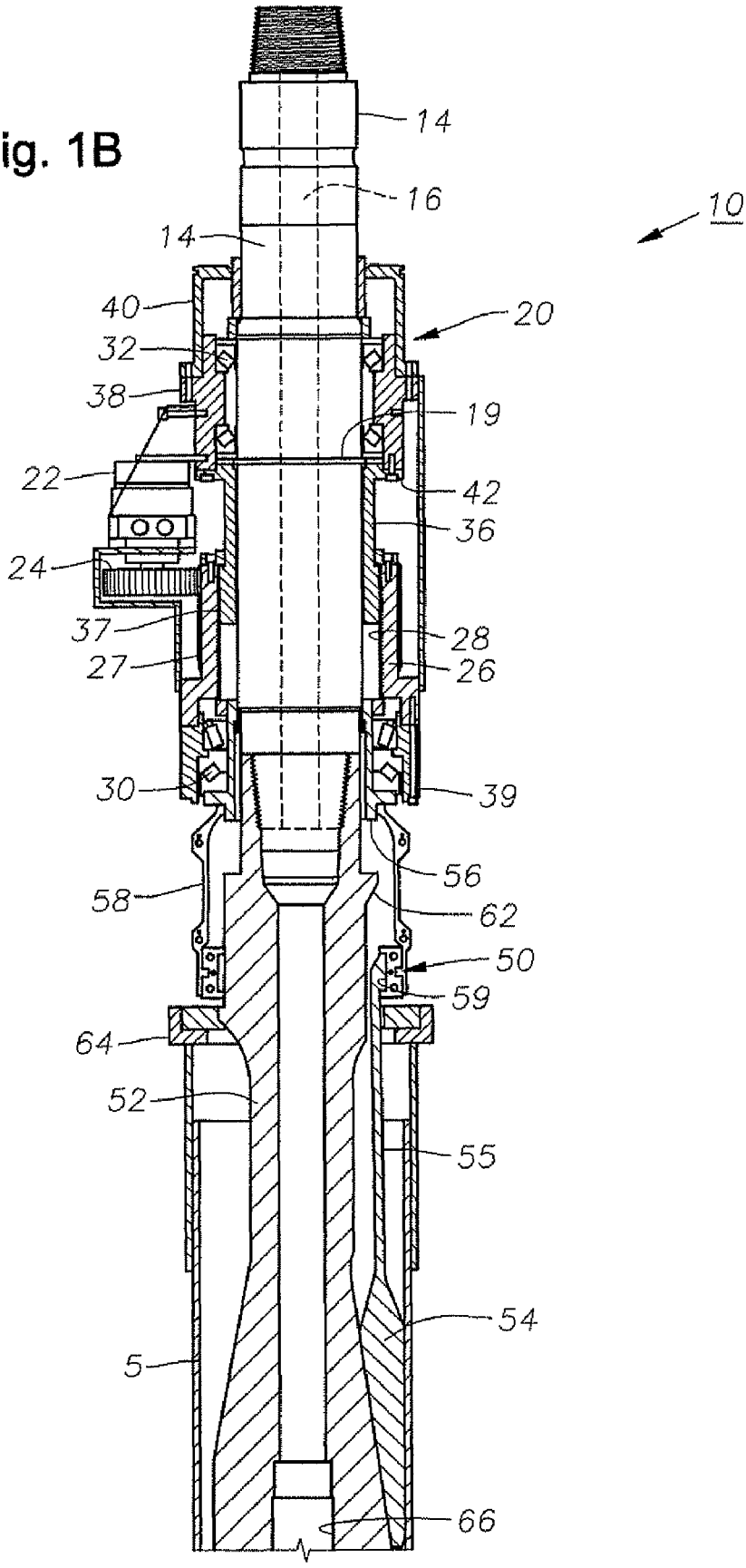
FIG. 1B is a sectional view of the internal pipe gripping assembly of FIG. 1A shown in a pipe gripping position.

Once pipe gripping assembly 10 is connected to casing 5, slips 54 will support the weight of casing 5 as well as transmit torque. Quill 14 will rotate in unison with top drive stem 4 (FIG. 3) while inner and outer tubular members 36, 26 and lower bearing sleeve 39 remain stationary. Inner drive bearing sleeve 56 is free to rotate in unison with the quill 14 and mandrel 52 due to the bearings 30. Axial movement of the lower bearing sleeve 39 is transmitted to the slips 54 through the drive collar connector 58 and slip collar 59. FIG. 1B shows the pipe gripping assembly 10 in the pipe engaged position. In this position, the inner tubular member 36, motor 22 and gear 24, upper bearing sleeve 38, the upper bearings 32 and the mandrel 52 are in the same axial position with respect to the quill 14. The outer tubular member 26, lower bearing sleeve 39, lower bearings 30, inner drive bearing sleeve 56, drive collar connector 58, slip collar 59, and slips 54 have moved axially downward and forced the slips to move along the lower tapered section of the mandrel 52 and into a gripping position on the casing 5. Gear 24 continues to engage splines 27 on inner tubular member 36, but at a higher point than when in the retracted position of FIG. 1A. Splines 27 have a longer axial length than the thickness of gear 24.

Stop shoulders 42 between the inner tubular member 36 and outer tubular member 26 prevent both over extension of the actuator 20 during actuation for pipe engagement and over retraction during pipe disengagement. Also, stop shoulder 62 on the mandrel 52 may also prevent over retraction of the actuator 20 during actuation for pipe disengagement. Spear head 65 (FIG. 4) attached to the mandrel 52 seals against the inner diameter of the casing 5 via a cup seal 71. This provides a sealed through-bore from the top drive 2 through the quill 14 to the mandrel 52 and through the spear head into the casing 5, through which water, mud, drilling fluid, cement and other slurries may be passed into the casing 5.

Figure 2A:
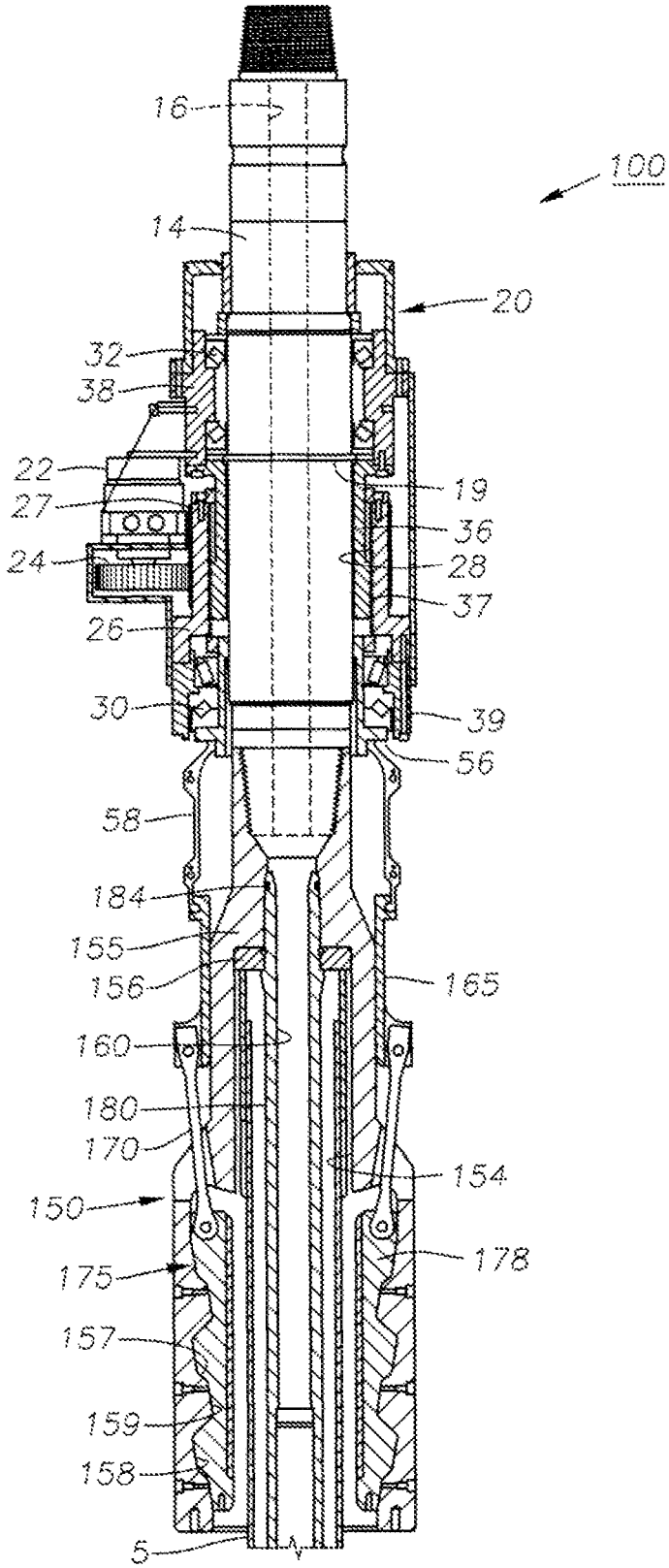
FIG. 2A is a sectional view of an external pipe gripping assembly with an actuator of the present invention and shown in a disengaged position.

FIG. 2A shows an external pipe gripping assembly 100. The external pipe gripping assembly 100 comprises a quill 14, an actuator 20, and an external pipe drive assembly 150. The external pipe drive assembly 150 is connected to both the quill 14 and the actuator 20. The external drive assembly includes an external mandrel 155, drive collar connector 58, external slip linkage collar 169, slip linkage 170, internal slip assembly 175 and spear 180. External mandrel 155 has an upper threaded end, a lower inwardly tapered section 157 and a through-bore 154. A stop shoulder 156 is located within through bore 154. Inwardly tapered section 157 includes at least one inwardly tapered ramp section that transitions from a first taper on a major inner diameter 158 to a second taper on a minor inner diameter 159. The external mandrel 155 is connected to the quill 14 via pipe threads. Internal slip assembly 175 mounts to the external mandrel 155 along the lower inwardly tapered section 157. Internal slip assembly 175 includes a plurality of internal slips 178, each having a profile that mates with the profile of tapered section 157.

Spear 180 has a threaded end for connecting it to the external mandrel 155 and a through-bore 160. A spear head such as spear head 65 of FIG. 4 attaches to spear 180. Seals 184 are located on the external diameter of the spear 180 at the upper end to seal the bore between the external mandrel 150 and spear 180. Cup seal 71 (FIG. 4) inserts into the casing 5 to keep any fluids in the bore of the pipe from passing around the spear 180 and by the cup seal 71.

In operation, the external pipe drive assembly 150 is mounted to top drive 2 (FIG. 3) on a drilling rig in exactly the same manner as described previously, namely via pipe threads on the upper end of the quill 14 and via anti-rotation bracket (not shown) between the upper bearing sleeve 38 and the top drive. When the top drive 2 and external pipe drive assembly 150 are lowered onto a section of casing 5, the external mandrel 155 and slip assembly 175 will pass over the casing until the stop shoulder 156 prevents further passage of the mandrel 155 over the casing. In this position, power is applied to the motor 22 to turn the gear 24. The gear 24 acts against the splines 27 and turns the outer tubular member 26 with respect to the inner tubular member 36. This rotation along the threads between the outer and inner tubular members 26, 36 forces the outer tubular member 26 to move axially in relation to the inner tubular member 36. Axial movement of the outer tubular member 26 imparts axial movement on the lower bearing sleeve 39. Lower bearing sleeve 39 imparts axial movement on the inner drive bearing sleeve 56 through bearings 30. Inner drive bearing sleeve 56 moves axially without rotation relative to quill 14.

Figure 2B:
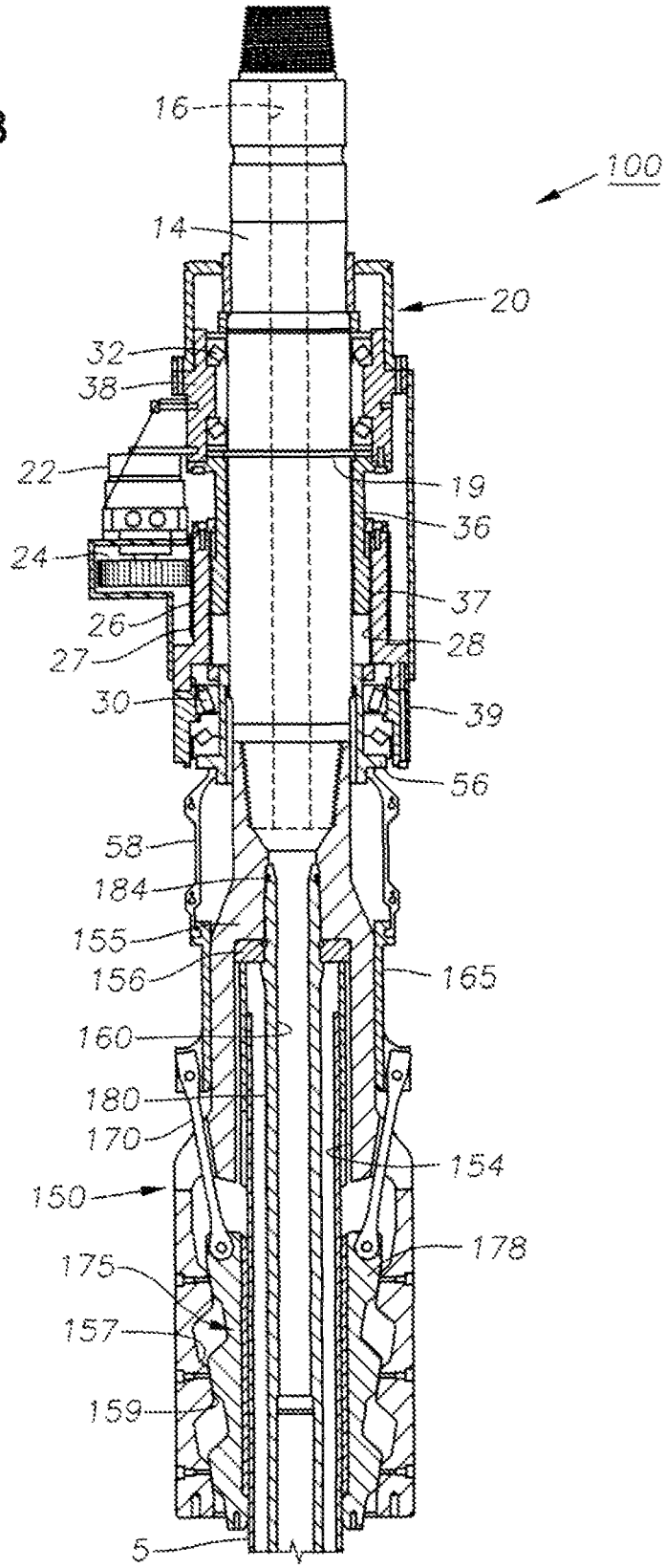
FIG. 2B is a sectional view of the external pipe gripping assembly of FIG. 2A and shown in an pipe gripping position.
Figure 4:
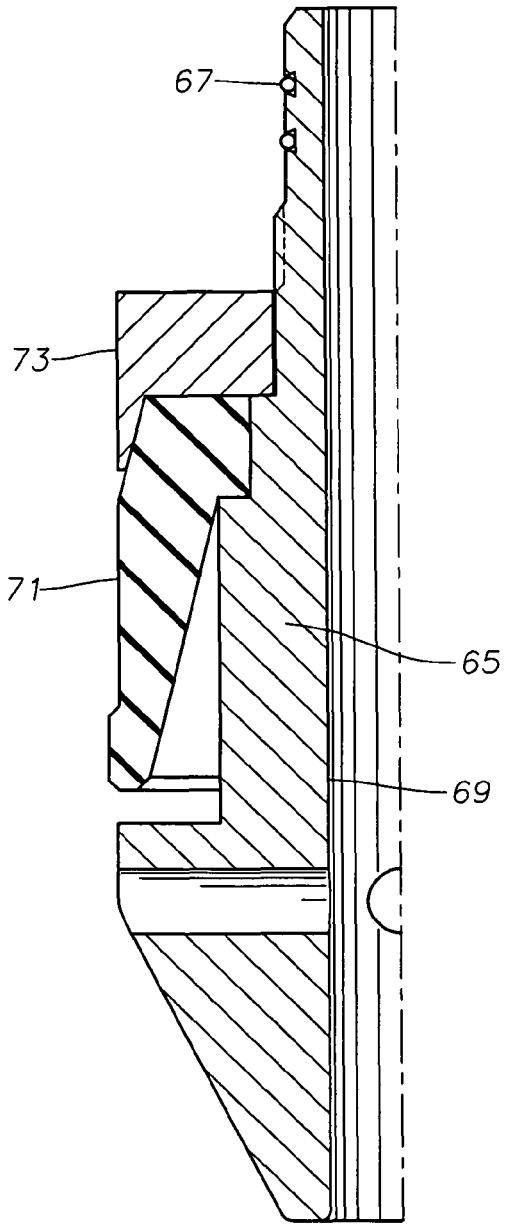
FIG. 4 is an enlarged sectional view of a spear head and cup seal that attaches to the gripping assembly of FIG. 1A or 2A.

Axial movement of the inner drive bearing sleeve 56 is transmitted to internal slips 178 through the drive collar connector 58, external slip linkage collar 165, and slip linkage 170. FIG. 2B shows the external pipe gripping assembly 100 in the pipe engaged position. In this position, the inner tubular member 36, motor 22 and gear 24, upper bearing sleeve 38, upper bearings 32 and external mandrel 155 are in the same axial position with respect to the quill 14. The outer tubular member 26, lower bearing sleeve 39, lower bearings 30, inner drive bearing sleeve 56, drive collar connector 58, external slip linkage collar 165, slip linkage 170, and internal slip assembly 175 have moved axially downward and forced the internal slips 178 to move from the first taper to the second taper and into a gripping position on the pipe. The spear 180 attached to the external mandrel 150 seals against the inner diameter of the pipe 5 via cup seal 71 (FIG. 4). This provides a sealed through-bore from the top drive 2 through the quill 4 to the external mandrel 155 and through the spear 180 into the casing 5, through which water, mud, drilling fluid, cement and other slurries may be passed into the casing 5.

The pipe gripping assembly and actuator described have significant advantages. The embodiments shown do not require the use of hydraulic cylinders, which are prone to leakage at the many piston seals that are required for such designs. This is likely to result in less maintenance and fewer repairs and refurbishment requirements over the life of the tool. Moreover, the pipe gripping assembly does not require the presence of personnel in the vicinity of the pipe at the rig floor while it is being made up or broken apart.

While the invention has been shown in only a few of its various forms, it should be apparent to those skilled in the art that it is not so limited but is susceptible to various changes without departing from the scope of the invention. For example, although the actuator in the embodiments in FIGS. 1 and 2 is shown in a configuration that strokes the slips downward into engagement with the pipe, it could easily be configured to stroke the slips upward to cause pipe engagement.

The invention claimed is:

1. A pipe gripping assembly for a drilling rig, comprising:

a quill having an axis and a threaded upper end adapted to be connected to a top drive of a drilling rig;

a set of slips carried by the quill and axially movable relative to the quill from a retracted position to an extended position into gripping engagement with a pipe;

a motor mounted to the quill, the motor having an output shaft that is rotatable relative to the quill; and a motion conversion assembly mounted to the quill in driven engagement with the output shaft of the motor and in driving engagement with the slips, the motion conversion assembly converting rotary motion of the shaft into axial motion of the slips.

2. The pipe gripping assembly of claim 1, wherein the output shaft of the motor is alongside and parallel to the axis of the quill.

3. The pipe gripping assembly of claim 1, wherein the quill is rotatable relative to the motor.

4. The pipe gripping assembly of claim 1, further comprising:

a drive gear mounted to the output shaft; and wherein the motion conversion assembly comprises:

a tubular member surrounding the quill and having driven members on its exterior that mate with the drive gear, the tubular member being rotatable and axially movable relative to the quill;

a stationary sleeve surrounding the quill and being non-rotatable and non-axially movable relative to the tubular member; and engaging threads between the tubular member and the sleeve, so that rotation of the motor causes the tubular member to rotate relative to the quill, and the engaging threads cause the tubular member to move axially relative to the quill.

5. The pipe gripping assembly of claim 1, further comprising:

a cup seal carried by the quill for sealing engagement with an inner diameter of the pipe.

6. The pipe gripping assembly of claim 1, further comprising:

a plug launcher carried by the quill below the slips, the plug launcher having a passage that registers with a passage in the quill; and a plug releasably mounted to the plug launcher, the plug having a passage that registers with the passage in the plug launcher, the passage in the plug having a seat therein for engagement by an object dropped through the passage in the quill, enabling fluid pressure applied to the passage of the quill to release and pump the plug down the pipe.

7. A pipe gripping assembly, comprising:

a quill having upper and lower ends and a passage therethrough;

an upper tubular member including an external thread and mounted in fixed axial relation to the quill;

a lower tubular member having an internal surface and an external surface, including a thread on the internal surface coupled to the external thread on the upper tubular member, and a spline on its external surface; and a motor having a shaft and a gear mounted to the shaft, the motor being mounted to the upper tubular member, the gear engaging the spline on the lower tubular member, wherein power applied to turn the motor forces rotation of the shaft and gear, which rotates the lower tubular member with respect to the upper tubular member and axially moves the upper tubular member with respect to the lower tubular member through cooperation of the threads between the two members.

8. The pipe gripping assembly according to claim 7, further comprising:

an upper bearing mounted between the upper tubular member and the quill;

a drive assembly mounted to the lower end of the quill, comprising a mandrel having a surface, a portion of which is tapered, and at least one slip mounted along the tapered portion of the mandrel;

a drive coupling assembly, comprising an outer bearing sleeve connected to the lower tubular member, an inner bearing sleeve interconnected to the at least one slip, and a lower bearing located between the outer bearing sleeve and the inner bearing sleeve; and wherein the quill, drive assembly and inner bearing sleeve rotate through the upper and lower bearings independently of the motor and upper and lower tubular members.

9. The pipe gripping assembly according to claim 8, wherein the drive assembly grips the well tubular internally.

10. The pipe gripping assembly according to claim 8, wherein the drive assembly grips the well tubular externally.

11. The pipe gripping assembly of claim 8, further comprising:

a spear head releasably mounted to the mandrel; and a cup seal mounted to the mandrel for sealing engagement with an inner diameter of the pipe.

12. The pipe gripping assembly of claim 11, further comprising:

a plug launcher mounted to the mandrel in lieu of the spear head, the plug launcher having a passage that registers with a passage in the mandrel; and a plug releasably mounted to the plug launcher, the plug having a passage that registers with the passage in the plug launcher, the passage in the plug having a seat therein for engagement by an object dropped through the passage in the quill, enabling fluid pressure applied to the passage of the quill to release and pump the plug down the pipe.

13. The pipe gripping assembly according to claim 7, wherein the motor is a stepping motor.

14. The pipe gripping assembly according to claim 7, wherein the motor is pneumatically, hydraulically, or electrically powered.

15. A pipe gripping assembly comprising:

a first tubular with a bore, an upper coupling at an upper end for connection to a top drive of a drilling rig, and a lower coupling at a lower end;

a tapered body coupled to the first tubular via the lower coupling;

a second tubular with a threaded portion;

a motor mounted to the second tubular and having an external gear;

a third tubular with an external spline in meshing engagement with the external gear, the third tubular having a threaded portion and a lower end having a coupling, wherein the third tubular is threaded to the second tubular via the respective threaded portions; and a set of slips mounted on the tapered body and connected to the coupling of the third tubular, wherein rotation of the gear by the motor causes the third tubular to rotate relative to the second tubular, and the threaded portions cause the third tubular to move axially relative to the second tubular, thereby moving the slips along the tapered body to an extended or a gripping position.

16. The pipe gripping assembly of claim 15, further comprising:

a spear head releasably carried by the mandrel; and a cup seal mounted to the spear head for sealing engagement with an inner diameter of the pipe.

17. The pipe gripping assembly of claim 16, further comprising:

a plug launcher carried by the mandrel in lieu of the spear head, the plug launcher having a passage that registers with a passage in the mandrel; and a plug releasably mounted to the plug launcher, the plug having a passage that registers with the passage in the plug launcher, the passage in the plug having a seat therein for engagement by an object dropped through the passage in the quill, enabling fluid pressure applied to the passage of the quill to release and pump the plug down the pipe.

18. The pipe gripping assembly of claim 15, wherein the first tubular is rotatable relative to the second and third tubulars.

19. The pipe gripping assembly of claim 15, wherein the threaded portion of the second tubular is on an external portion of the second tubular, and the threaded portion of the third tubular is on an internal portion of the third tubular.

20. The pipe gripping assembly of claim 15, further comprising a lower bearing between the slips and the third tubular that enables the first tubular and the slips to rotate in unison and relative to the second and third tubulars.

21. A method of connecting first and second joints of pipe on a rig using a top drive, the method comprising:

(a) mounting a pipe gripping assembly to the top drive;

(b) positioning the first joint of pipe in slips on the rig;

(c) positioning the second joint of pipe in a location where the pipe gripping assembly may engage the second joint of pipe;

(d) actuating a motor on the pipe gripping assembly to move a set of slips into gripping engagement with the second joint of pipe;

(e) moving the top drive to a position that inserts a lower end of the second joint of pipe into engagement with an upper end of the first joint of pipe;

(f) rotating the top drive and the slips to connect the first and second joints of pipe to each other; wherein step (d) comprises:

rotating a shaft of the motor;

converting rotation of the shaft to axial movement relative to an axis of the pipe gripping assembly; and moving the slips axially relative to the quill in response thereto.

22. The method of claim 21, further comprising the step of flowing a slurry through the joints of pipe from a bore in the top drive.

* * * * *